United States Patent [19]

Owen

[11] Patent Number: 4,817,787

[45] Date of Patent: Apr. 4, 1989

[54] DETONATONG CORD SAFETY TRANSPORT SYSTEM

[75] Inventor: Harrold D. Owen, Fort Worth, Tex.

[73] Assignee: Owen Oil Tools, Inc., Fort Worth, Tex.

[21] Appl. No.: 190,710

[22] Filed: May 6, 1988

[51] Int. Cl.[4] ..... B65D 81/02

[52] U.S. Cl. ..... 206/3; 206/591; 206/592; 206/523; 206/587

[58] Field of Search ..... 206/3, 591, 592, 523, 206/587

[56] References Cited

U.S. PATENT DOCUMENTS

| | | | |
|---|---|---|---|
| 2,208,873 | 7/1940 | Rosenberg | 206/495 X |
| 2,352,998 | 7/1944 | Alexander et al. | 206/3 |
| 2,601,919 | 7/1952 | Darbyshire | 206/3 |
| 4,055,247 | 10/1977 | Benedick et al. | 206/591 |
| 4,286,708 | 9/1981 | Porzel | 206/3 |
| 4,586,602 | 5/1986 | Levey | 206/3 |

*Primary Examiner*—William Price
*Attorney, Agent, or Firm*—Robert A. Felsman

[57] ABSTRACT

A system for safely transporting detonating cord that uses a container with a mounting board of insulating material with a walled path through which the cord is threaded. The path has a series of loop regions and adjoining, parallel regions through which the parallel cord is separated with a cord separator that will sever adjoining cord in the event of a detonation to terminate further cord detonation. A separator card of cardboard is an ideal separator means. The walled path must otherwise insulate the detonating cord, being formed in one embodiment of cylindrical cardboard tube and in another of expanded polystyrene having a path with an open top. Fastener means secures the detonating cord within the walled path, being "Nylon" in the tube embodiment and interference fit in the expanded polystyrene embodiment.

10 Claims, 5 Drawing Sheets

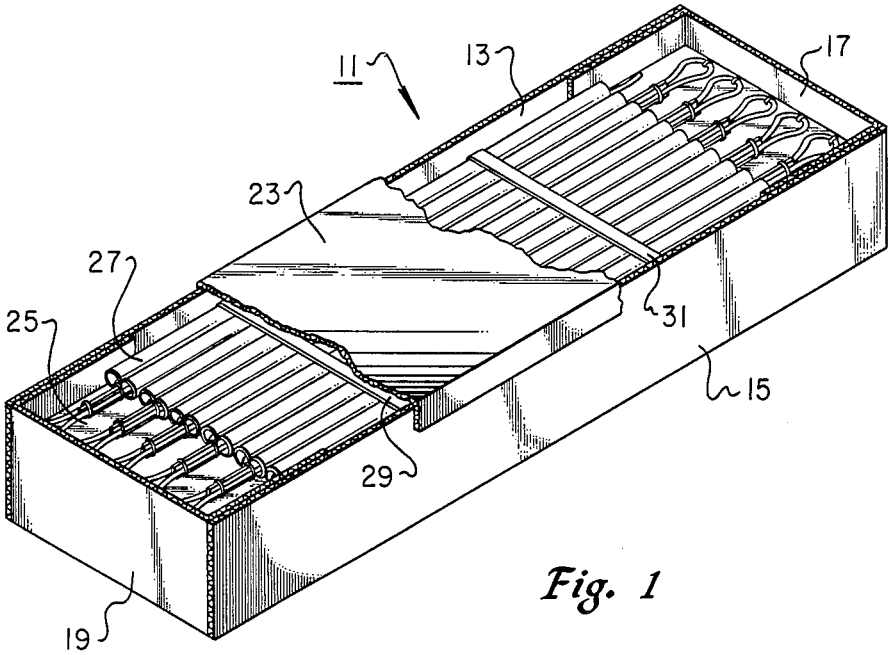
Fig. 1
Fig. 2
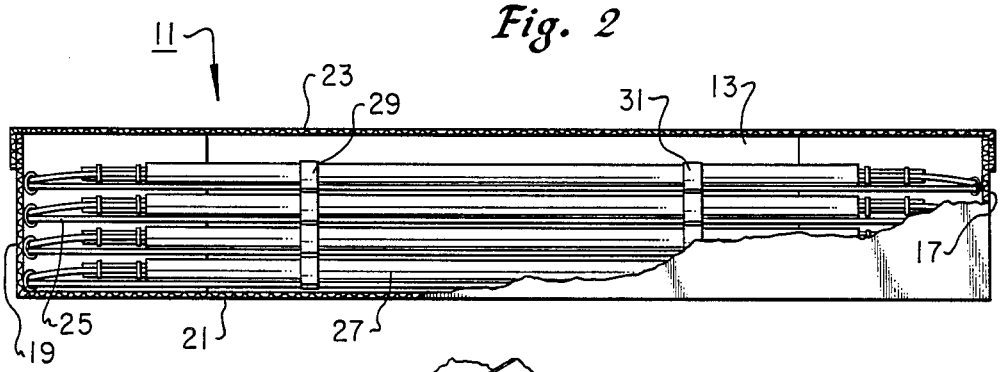
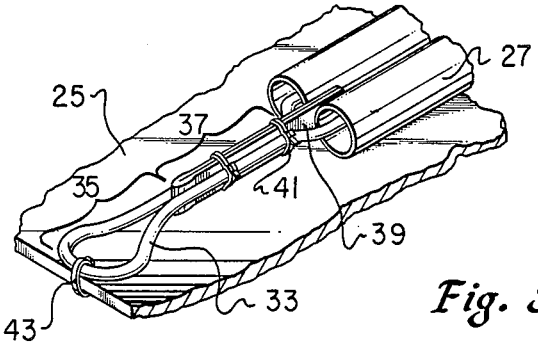
Fig. 3

DETONATONG CORD SAFETY TRANSPORT SYSTEM

BACKGROUND OF THE INVENTION

1. Field of the Invention

This invention is a packaging system for transporting an explosive substance known as detonating cord safely enough for use in commercial air carriers.

2. Background Information

A system for transporting detonating cord used in the petroleum exploration and production industry is disclosed in U.S. Pat. No. 4,586,602, "Detonating Cord Transport System", May 6, 1986. Here, detonating cord is installed on separator-support members with crossover locations at frequent intervals. At each crossover interval is a means for confining detonation to a relatively short length of cord. This system has some disadvantages which the present invention overcomes, including relative difficulty of assembly and limited lengths of cord in each container.

SUMMARY OF THE INVENTION

It is the general object of this invention to provide an improved system for safely transporting detonating cord.

This and other objects of the invention are achieved with a system that includes a container with mounting board of insulating material having a walled path with a series of loop regions and adjoining parallel regions. A cardboard separator between the det cord in the parallel regions is used to sever adjoining det cord in the event of a detonation and to terminate further det cord detonation. Means are used to secure each cardboard separator means within the associated parallel region.

In one embodiment of the invention the mounting board is constructed of material having selected insulating characteristics, preferably styrofoam, the walled path being defined by a groove that has an open top. The cord is sized to be inserted through the open top of the groove and to be retained by interference with the walls of the groove.

In another embodiment the walled path is tubular, with the detonating cord threaded through the tubes. Each tube is shorter in length than the associated container, and the series of loop and parallel regions of the cord are formed between the ends of the tubes and the container. Retainer means hold the det cord in the selected position.

Preferably, a separator of cardboard of selected thickness is used, which consistently severs adjoining parallel cord, if detonated, to terminate further det cord detonation.

Additional objects, features and advantages of the invention will become apparent in the following description.

DESCRIPTION OF THE DRAWINGS

FIG. 1 is a fragmentary perspective showing one embodiment of a detonating cord safety transport system that employs the principles of the invention.

FIG. 2 is a fragmentary side elevational view of the FIG. 1 embodiment.

FIG. 3 is an enlarged fragmentary perspective view of a portion of the FIG. 1 embodiment.

DESCRIPTION OF THE PREFERRED EMBODIMENTS

Figure 4:
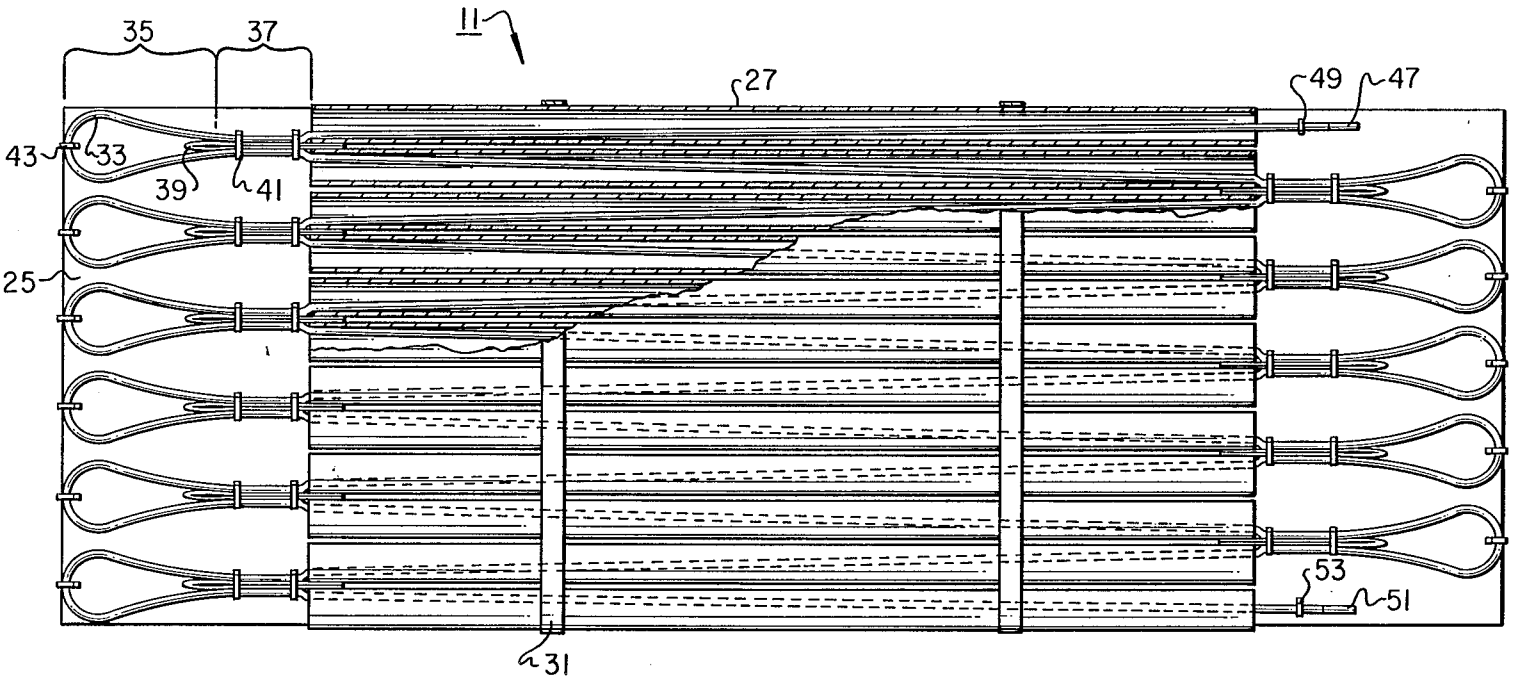
FIG. 4 is a top view of the FIG. 1 embodiment, with the top of the container removed.
Figure 5:
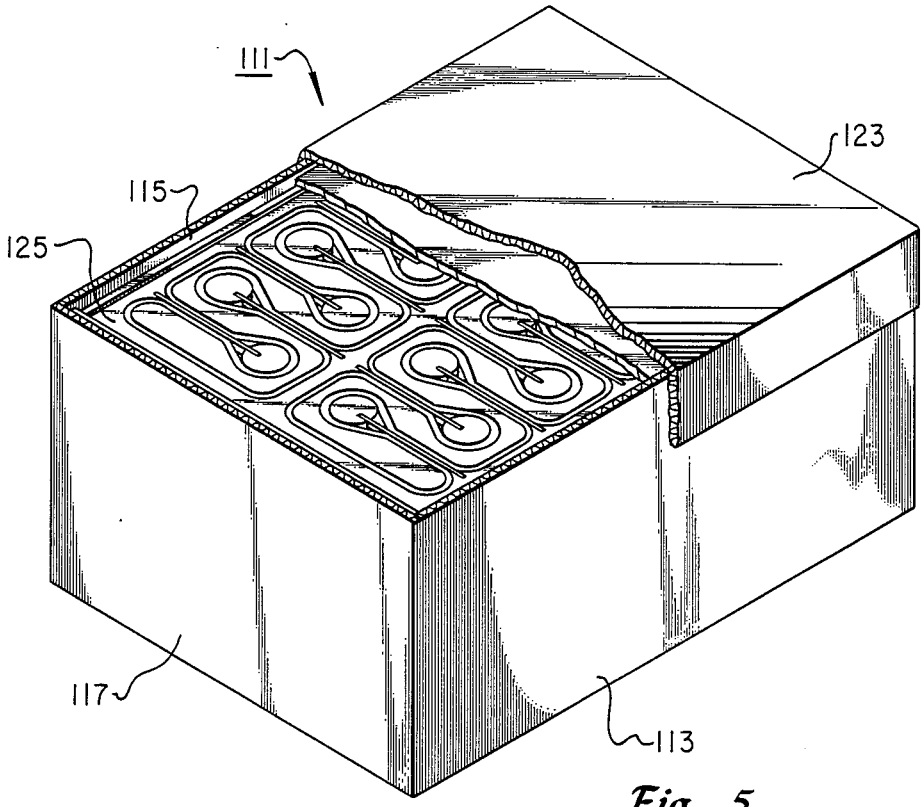
FIG. 5 is fragmentary perspective view of an alternate embodiment of the invention.
Figure 6:
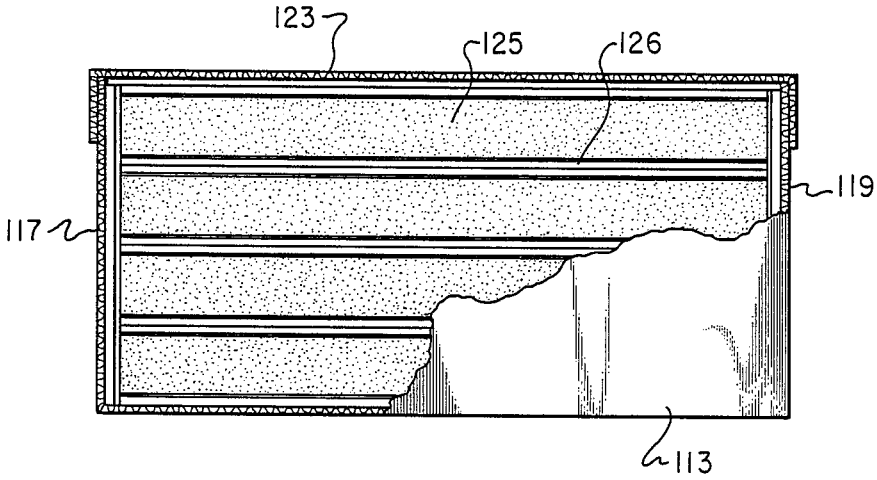
FIG. 6 is a fragmentary side view of the FIG. 5 embodiment.

The numeral 11 in the drawings designates the container of a detonating cord safety transport system, constructed in this instance of corrugated cardboard with sidewalls 13, 15 connected with end walls 17, 19 that support a bottom 21 (see FIG. 2) and a top 23.

Within the container 11 is assembled a stacked series of mounting board 25, preferably of press board, upon which rest parallel tubes 27. A pair of straps 29, 31 connect the stacked series of mounting board 25 and parallel tubes 27 into a cohesive unit. Each of the tubes constitutes an insulated, walled path through which a continuous length of detonating cord 33 is threaded. The detonating cord is thus arranged into parallel rows, separated and insulated from one another by the walls of the tubes 27, which have a thickness of preferably about ¼ inch. The length of the container 11 and mounting board 25 is greater than the length of the tubes 27 to form a space of selected length. Within this space the cord forms a series of loop regions 35 (see FIG. 3) and adjoining parallel regions 37 adjacent the ends of the tubes.

Between the cord in each parallel region 37 is a cardboard separator means of selected constituency, thickness and length. As shown in FIG. 3, a separator 39 of cardboard is utilized, being held by fastener means such as the plastic retainer strip 41. Additional retainer strip 43 is used to confine the loop region 35 at the end 45 of the mounting board 25. As best seen in FIG. 4, the continuous length of detonating cord 33 is threaded through each of the tubes 27, beginning at one end 47 (retained by fastener 49) and ending at the other end 51 (retained by fastener 53) on the carrier board 25.

In the unfortunate event of accidental detonation of det cord 33 at any location the detonation will be stopped at the first end loop at which the detonation reaches. As the det cord detonates past the area 37, the detonation causes the det cord on the opposite side of the cardboard separator to be severed so that the detonation of the det cord will be ended at that point.

An alternate form of the invention is illustrated in FIGS. 5–10, in which a container 111 is preferably a corrugated cardboard box having sidewalls 113, 115 and endwalls 117, 119 joined by a bottom 121, all supporting a removable top 123.

Within the container 111 is stacked series of mounting board 125, preferably of expanded polystyrene, known by the trademark "Styrofoam" owned by Dow Chemical or a material having its insulating characteristics, separated by press board 126.

Figure 7:
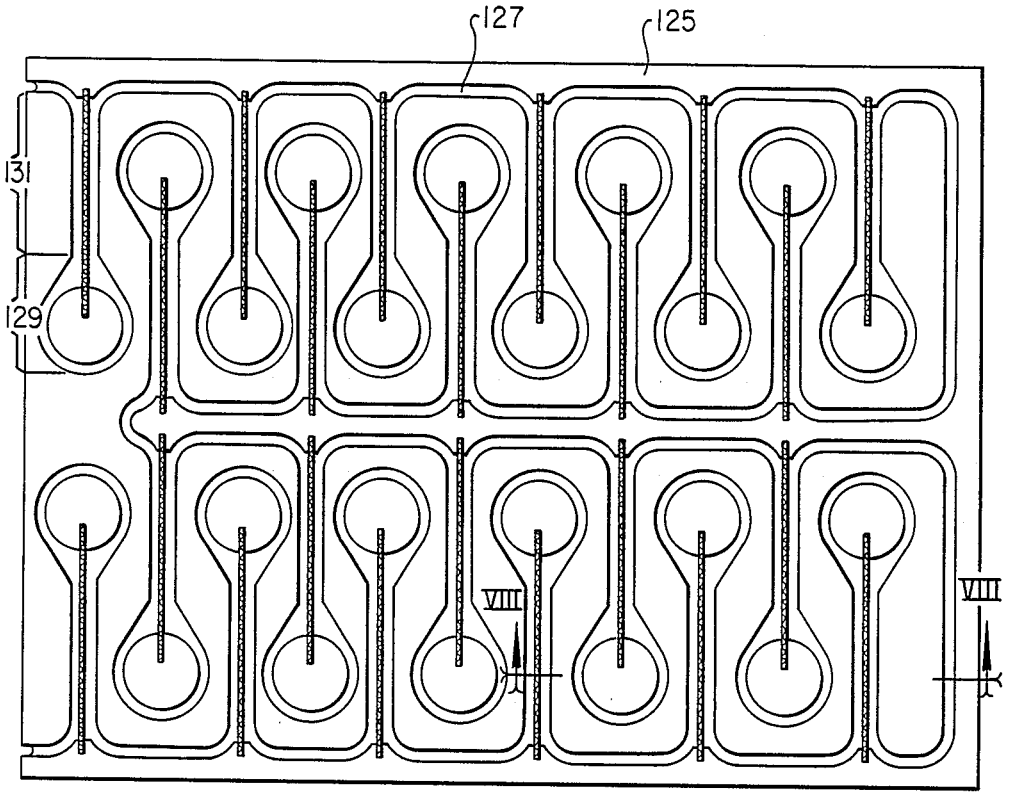
FIG. 7 is a top view of the FIG. 5 embodiment, with the top of the container and detonating cord removed to better show the groove and cord separators.
Figure 8:
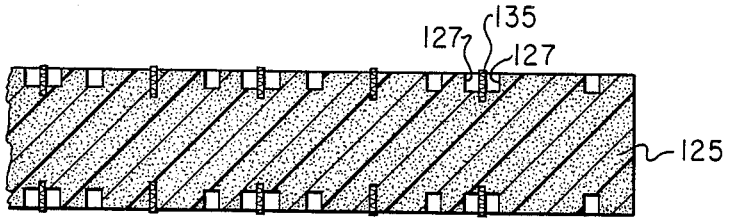
FIG. 8 is a cross sectional view as seen looking along the lines VIII—VIII of FIG. 7.
Figure 9:
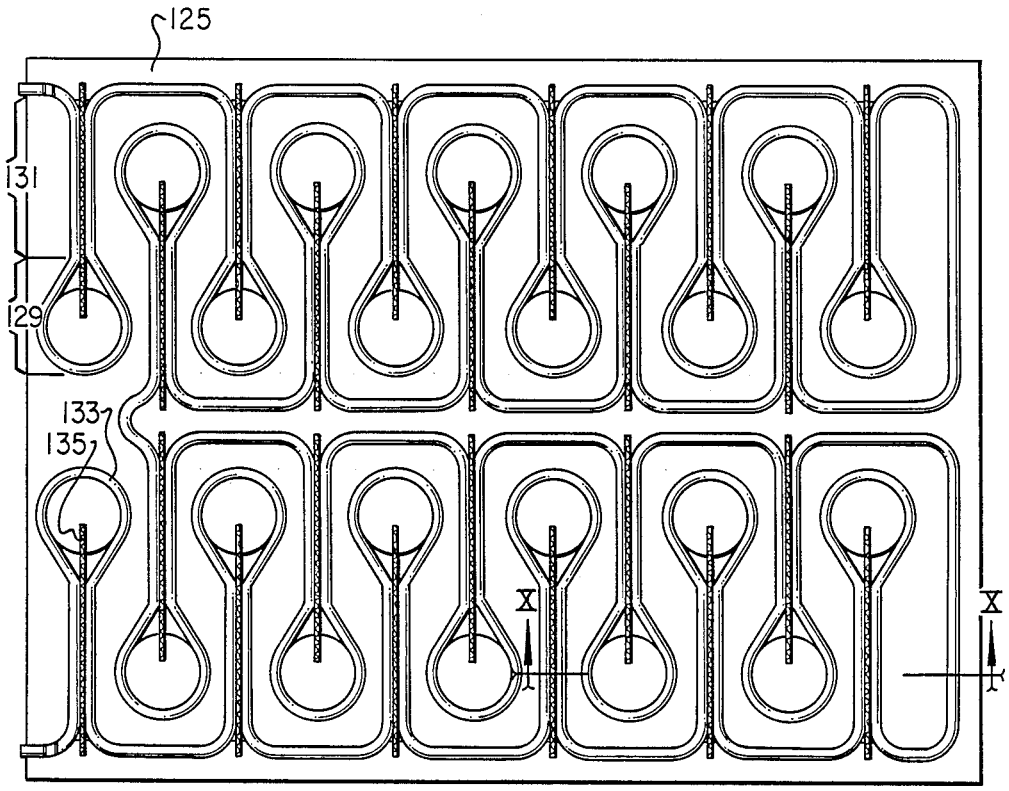
FIG. 9 is a top view, similar to FIG. 7, with detonator cord included.
Figure 10:
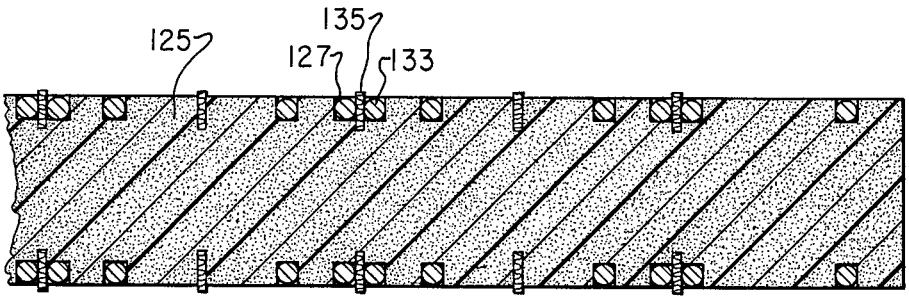
FIG. 10 is a cross sectional view seen looking along the lines X—X of FIG. 9.

As shown in FIG. 7, the top of each mounting board 125 contains a continuous groove 127 that defines a walled, open top path with a series of loop regions 129 and adjoining parallel regions 131. A continuous length of detonating cord 133 (see FIGS. 9 and 10) is sized for insertion and threading through the open top of the walled path or groove 127 and is retained by interference between the walls. In each parallel region 129, and between a parallel portion of the grooves 127, is a separator means 135 (see FIG. 8), held in position by insertion into a mating slot in the mounting board 125. Here, as in the other embodiment, the separator means is preferably a separator constructed of cardboard, a preferred thickness being about 0.080 inch. The minimum separation of the cord in other locations in the expanded polystyrene should not be less than substantially 0.205 inch or a distance depending on the material used, which will not allow the adjacent det cord to be initiated.

In testing of the FIG. 1–4 embodiment the detonating cord 33 successfully severed any time the detonation reached a parallel region 37 having a separator card 39 between the det cord. This is a superior manner of packaging and transporting safely detonating cord.

The embodiment of FIGS. 5–10 has additional advantages. Assembly is much easier and faster since it is not necessary to thread cord through tubes. Rather, the cord is simply pushed into the grooves after insertion of the separator cards. Also eliminated is the need for using numerous fasteners to hold the tubes and cord in the selected locations. Expanded polystyrene is an exceptional and lightweight insulator, being successful to prevent detonation of adjoining cord if separated by a minimum distance of only 0.205 inch. In the preferred embodiment the cord is separated by 5/8th inch except in the parallel regions 131. An expanded polystyrene mounting board 125 which is 17×24×2 inches can therefore hold approximately thirty-one feet of cord, and a full series of four boards with ¾ inch fiberboard, a maximum of 250 feet of 80 grain cord.

While the invention has been shown in only two of its forms, it should be apparent to those skilled in the art that it is not thus limited, but is susceptible to various changes and modifications without departing from the spirit thereof.

I claim:

1. A detonating cord safety transport system comprising:

a container;

a mounting board of insulating material inside the container, with a walled path of selected configuration;

detonating cord threaded through the walled path, with a series of loop regions and adjoining, parallel regions;

a cord separator means between the det cord in the parallel regions to sever adjoining cord, if detonated, and terminate further det cord detonation;

means to secure each cord separator means within an associated parallel region.

2. The invention defined by claim 1 wherein the cord separator means is a separator card constructed of cardboard.

3. The invention defined by claim 2 wherein the cardboard is about 0.080 inch thick.

4. A detonating cord safety transport system comprising:

a container;

a mounting board including a continuous groove to define an insulated walled, open top path with a series of loop regions and adjoining, parallel regions;

a continuous length of detonating cord, sized for insertion through the open top of the walled path, threaded through and retained by interference in the path;

a cord separator means between the cord in the parallel regions to sever the adjoining cord, if detonated, and terminate further cord detonation;

means to secure each cord separator means within an associated parallel region.

5. The invention defined by claim 4 wherein the mounting board has the insulating characteristics of expanded polystyrene and detonating cord in the loop regions is separated by a minimum distance of not less than substantially 0.205 inch.

6. The invention defined by claim 5 wherein the cord separator means is a separator card constructed of cardboard.

7. The invention defined by claim 6 wherein the cardboard is about 0.080 inch thick.

8. A detonating cord safety transport system comprising:

a container;

tubes, each shorter than the length of the container, to define a space of selected length between each end of the container and the ends of the tubes;

detonating cord threaded through the tubes, with a series of loop regions near the ends of the container and adjoining, parallel regions adjacent the ends of the tubes;

a cord separator means of selected constituency, thickness and length between the cord in the parallel regions to sever the cord, if detonated, and terminate further cord detonation;

fastener means to secure each cord separator means within an associated parallel region.

9. The invention defined by claim 8 wherein the tubes are cylindrical cardboard and the cord separator means is a separator card constructed of cardboard.

10. The invention defined by claim 9 wherein the tubes have a wall thickness of about ¼ inch and the cord separator cardboard is about 0.080 inch thick.

* * * * *

UNITED STATES PATENT AND TRADEMARK OFFICE

CERTIFICATE OF CORRECTION

PATENT NO. : 4,817,787

DATED : April 4, 1989

INVENTOR(S) : Harrold D. Owen, Fort Worth, Tex.

It is certified that error appears in the above-identified patent and that said Letters Patent is hereby corrected as shown below:

In the title page 1, item [54], please change

"DETONATONG" to
--DETONATING--.

Signed and Sealed this

Ninth Day of January, 1990

*Attest:*

JEFFREY M. SAMUELS

*Attesting Officer* *Acting Commissioner of Patents and Trademarks*